US006821091B2

(12) United States Patent
Lee

(10) Patent No.: US 6,821,091 B2
(45) Date of Patent: Nov. 23, 2004

(54) SECURING DEVICE

(75) Inventor: Kwing Wah Lee, Shatin (HK)

(73) Assignee: Litex Industries Inc., Grand Prairie, TX (US)

( * ) Notice: Subject to any disclaimer, the term of this patent is extended or adjusted under 35 U.S.C. 154(b) by 184 days.

(21) Appl. No.: 10/161,700

(22) Filed: Jun. 5, 2002

(65) Prior Publication Data

US 2003/0228224 A1 Dec. 11, 2003

(51) Int. Cl.[7] ..... F04D 29/34

(52) U.S. Cl. ..... 416/210 R; 416/206; 416/207; 416/214 R

(58) Field of Search ..... 416/5, 204 R, 416/205, 206, 207, 210 R, 214 R, 220 A, 221; 403/352, 353, 354, 345, 408.1

(56) References Cited

U.S. PATENT DOCUMENTS

| | | | | |
|---|---|---|---|---|
| 3,711,219 A | | 6/1973 | Strick | |
| 5,462,412 A | | 10/1995 | Scofield et al. | |
| 5,464,323 A | | 11/1995 | Scofield | |
| 5,501,010 A | | 3/1996 | Scott | |
| 5,944,486 A | * | 8/1999 | Hodgkins, Jr. | 416/210 R |
| 6,010,306 A | * | 1/2000 | Bucher et al. | 416/210 R |
| 6,039,540 A | | 3/2000 | Wu | |
| 6,241,476 B1 | | 6/2001 | Lee | |
| 6,336,792 B1 | | 1/2002 | Bucher et al. | |
| 6,508,629 B2 | * | 1/2003 | Kerr, Jr. | 416/210 R |
| 6,585,488 B1 | * | 7/2003 | Bucher et al. | 416/210 R |
| 6,652,236 B2 | * | 11/2003 | Hai | 216/206 |

FOREIGN PATENT DOCUMENTS

| | | |
|---|---|---|
| AU | 2000-48984 | 4/2001 |
| GB | 881806 | 11/1961 |

* cited by examiner

*Primary Examiner*—Christopher Verdier
(74) *Attorney, Agent, or Firm*—Leydig, Voit & Mayer, Ltd.

(57) ABSTRACT

A securing device for securing a connecting arm to a ceiling fan blade. The blade includes a hole through which a male member of the arm is inserted. The securing device includes a plate having an aperture through which the engagement end subsequently extends with the neck staying within the aperture. The aperture includes a smaller part having a rim portion such that the plate is slidable in a first direction along the blade surface until the rim portion engages behind the engagement end. The rim portion is enlarged for receiving and engaging with the engagement end in a second direction opposite to the first direction. The plate includes a resilient finger deformable upon engaging the blade surface, resiliently maintaining the engagement of the enlarged rim portion with the engagement end in the second direction. The finger engages the blade surface by friction, thereby holding the plate against sliding relative to the blade in the second direction.

30 Claims, 2 Drawing Sheets

SECURING DEVICE

The present invention relates to a securing device for securing a connecting arm to a ceiling fan blade.

BACKGROUND OF THE INVENTION

Securing devices for securing a connecting arm to a ceiling fan blade are generally known, for example as disclosed in U.S. Pat. No. 6,241,476. The construction and operation of this securing device are relatively complicated, as it includes a fork member for engagement with the connecting arm.

The invention seeks to mitigate or at least alleviate such a shortcoming by providing an improved securing device of this type in general.

SUMMARY OF THE INVENTION

According to a first aspect of the invention, there is provided a securing device for securing a connecting arm to a ceiling fan blade. The arm includes a male member comprising an engagement portion and a neck portion behind the engagement portion. The blade includes a hole through which the male member is insertable from one surface to the opposite surface of the blade such that the engagement portion and neck portion protrude beyond said opposite surface. The securing device comprises a body having at least one aperture through which the engagement portion protruding beyond said opposite blade surface is extendable with the neck portion staying within the aperture. The aperture includes a part having a rim portion and a size between the sizes of the engagement portion and the neck portion such that, when the engagement portion extends through the aperture, the body is slidable in a first direction along said opposite blade surface until the rim portion engages behind the engagement portion. The rim portion is enlarged for receiving and engaging with the engagement portion in a second direction opposite to the first direction. The body includes at least one resilient member resiliently deformable upon engaging said opposite blade surface when the rim portion engages behind the engagement portion, thereby maintaining under the action of resilience of the resilient member the engagement of the enlarged rim portion with the engagement portion in the second direction.

Preferably, the resilient member is resiliently deformable to engage said opposite blade surface by friction when the rim portion engages behind said engagement portion, thereby holding the body against sliding relative to said blade in the second direction.

Preferably, the body comprises a generally flat plate.

Preferably, the body is substantially completely made of a resiliently deformable material.

More preferably, the material comprises plastic material.

It is preferred that the aperture is of an oblong shape, comprising a relatively larger end through which said engagement portion protruding beyond said opposite blade surface is extendable and includes a relatively smaller end acting as said part of the aperture.

It is further preferred that the larger and smaller ends of the aperture are in the first and second directions respectively.

Preferably, that the body comprises three said apertures, through each of which said engagement portion of a respective said male member of said arm protruding beyond said opposite blade surface is extendable.

More preferably, the three apertures are arranged in a triangular manner on the body.

In a preferred embodiment, the resilient member comprises a first part connected to the body and a second part that extends from the first part to protrude out of the body for engaging said opposite blade surface.

Preferably, the second part of the resilient member extends from the first part in the second direction.

Preferably, the resilient member comprises a first section that extends from the first part to protrude out of the body and includes the second part for engaging said opposite blade surface, and a second section that extends from the second part towards the body.

Preferably, the body comprises three said resilient members protruding out of the body for engaging said opposite blade surface.

More preferably, the three resilient members are arranged in a triangular manner on the body.

In a specific construction, the body includes a plurality of said apertures and a plurality of said resilient members, which are arranged at alternating positions relatively to each other.

According to a second aspect of the invention, there is provided a securing device for securing a connecting arm to a ceiling fan blade. The arm includes a male member comprising an engagement portion and a neck portion behind the engagement portion. The blade includes a hole through which the male member is insertable from one surface to the opposite surface of the blade such that the engagement portion and neck portion protrude beyond said opposite surface. The securing device comprises a body having at least one aperture through which the engagement portion protruding beyond said opposite blade surface is extendable with the neck portion staying within the aperture. The aperture includes a part having a rim portion and a size between the sizes of the engagement portion and the neck portion such that, when the engagement portion extends through the aperture, the body is slidable in a first direction along said opposite blade surface until the rim portion engages behind the engagement portion. The body includes at least one resilient member resiliently deformable to engage said opposite blade surface by friction when the rim portion engages behind the engagement portion, thereby holding the body against sliding relative to the blade in a second direction opposite to the first direction.

Preferably, the rim portion is enlarged for receiving and engaging with said engagement portion in the second direction, and the resilient member is resiliently deformable upon engaging said opposite blade surface when the rim portion engages behind said engagement portion, thereby maintaining under the action of resilience of the resilient member the engagement of the enlarged rim portion with said engagement portion in the second direction.

Preferably, the body comprises a generally flat plate.

Preferably, the body is substantially completely made of a resiliently deformable material.

More preferably, the material comprises plastic material.

It is preferred that the aperture is of an oblong shape, comprising a relatively larger end through which said engagement portion protruding beyond said opposite blade surface is extendable and includes a relatively smaller end acting as said part of the aperture.

It is further preferred that the larger and smaller ends of the aperture are in the first and second directions respectively.

Preferably, the body comprises three said apertures, through each of which said engagement portion of a respective said male member of said arm protruding beyond said opposite blade surface is extendable.

More preferably, the three apertures are arranged in a triangular manner on the body.

In a preferred embodiment, the resilient member comprises a first part connected to the body and a second part that extends from the first part to protrude out of the body for engaging said opposite blade surface.

Preferably, the second part of the resilient member extends from the first part in the second direction.

Preferably, the resilient member comprises a first section that extends from the first part to protrude out of the body and includes the second part for engaging said opposite blade surface, and a second section that extends from the second part towards the body.

Preferably, the body comprises three said resilient members protruding out of the body for engaging said opposite blade surface.

More preferably, the three resilient members are arranged in a triangular manner on the body.

In a specific construction, the body includes a plurality of said apertures and a plurality of said resilient members, which are arranged at alternating positions relatively to each other.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figures 1, 1A:
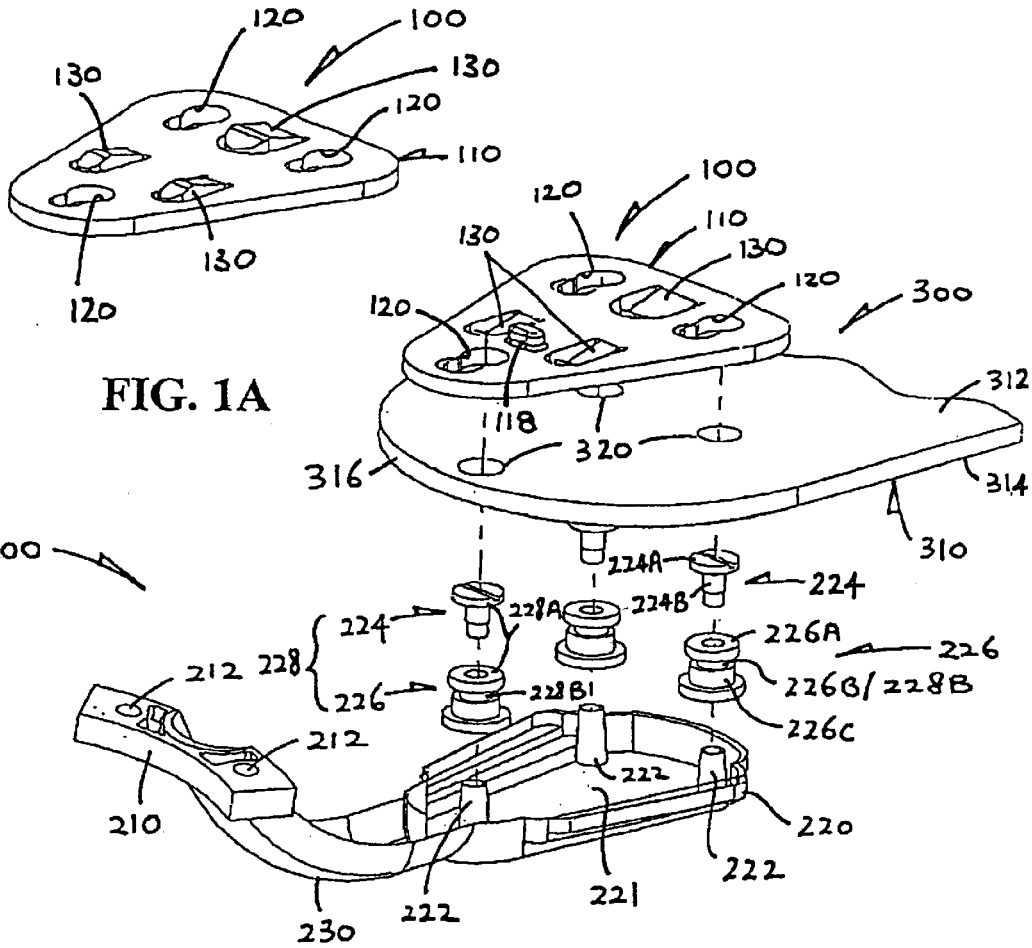
FIG. 1 is exploded top perspective view of an embodiment of a securing device in accordance with the invention, for securing a connecting arm to a ceiling fan blade as shown.
FIG. 1A is a perspective view of the securing device of FIG. 1, shown upside down.
Figure 2:
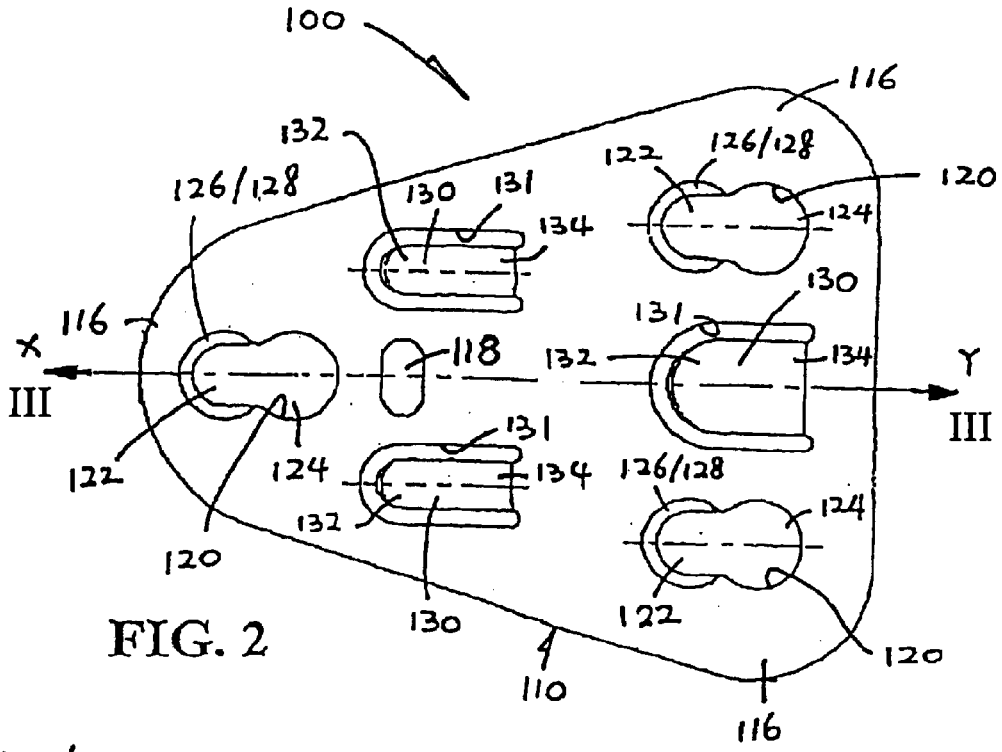
FIG. 2 is a top plan view of the securing device of FIG. 1.
Figure 3:
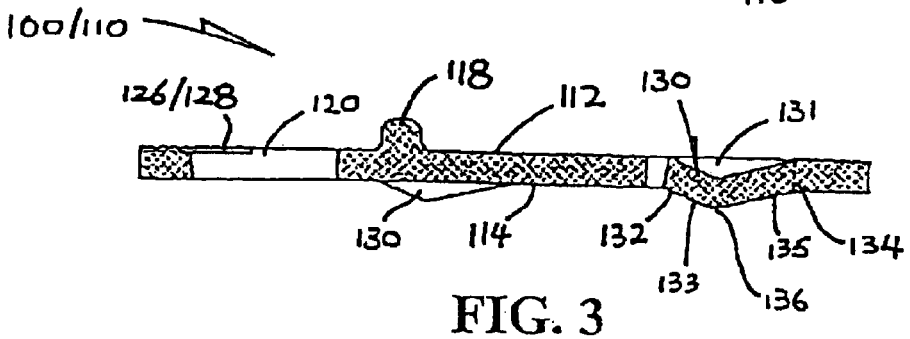
FIG. 3 is a cross-sectional side view of the securing device of FIG. 2, taken along central axis III—III thereof.
Figure 4:
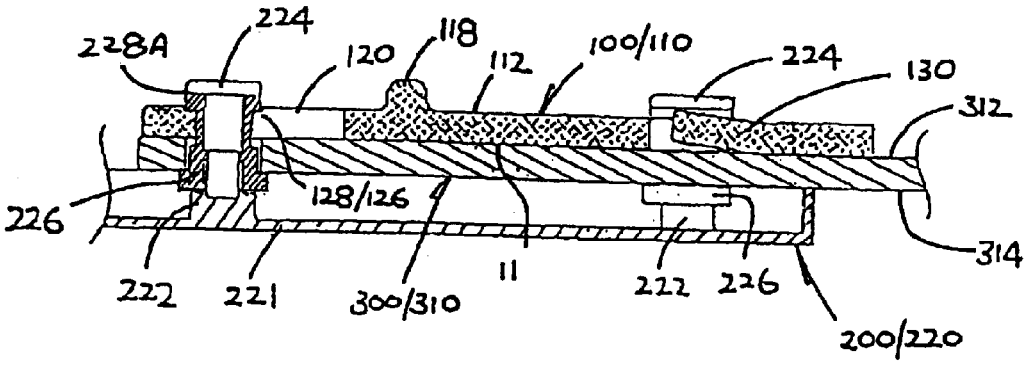
FIG. 4 is a cross-sectional side view corresponding to FIG. 3, showing the securing device and parts of the arm and fan blade of FIG. 1 in an assembled condition.

Referring to the drawings, there is shown a securing device 100 embodying the invention for securing a connecting arm 200 to a ceiling fan blade 300, which device 100 comprises a generally flat body plate 110 of uniform thickness and moulded from a plastic material. The securing plate 110 has a generally triangular shape symmetrical about a central axis III—III of FIG. 2, and includes upper and lower sides/surfaces 112 and 114, three round corners 116 and a push knob 118 on the upper surface 112.

Three apertures 120 are formed in the securing plate 110 at symmetrical positions adjacent the corners 116 respectively, which are arranged in a triangular manner sharing the same central axis III—III and pointing in the same direction X as the securing plate 110. The securing plate 110 includes three resilient tabs or fingers 130 which are arranged in a triangular manner sharing the same central axis III—III, but pointing in the opposite direction Y.

Each of the apertures 120 is of an oblong shape resembling a keyhole, having an individual central axis parallel to the main central axis III—III. Each aperture 120 has a relatively smaller end 122 in direction X and a relatively larger end 124 in direction Y. An arcuate shallow step 126 is formed on the upper surface 112 of the securing plate 110, which extends along the part-circular rim portion of the smaller end 122 of each aperture 120 over an angle exceeding 180° or of about 270°. The arcuate step 126 has the same outer diameter as the larger end 124 such that, insofar as the upper plate side 112 is concerned, the smaller end 122 is recessed to have an enlarged rim portion forming a recess 128 of the same size as the larger end 124.

Each of the fingers 130, which is formed as a result of a U-shaped slot 131 through the securing plate 110, has a free end 132 defined by the bend of the slot 131 in direction X and an opposite, integrally connected, fixed end 134 bridging across the two opposed ends of the slot 131. Each finger 130 is bent at the fixed end 134 through an angle of about 20° downwards and then crooked at about two-third of its length through an angle of about 45° upwards. Thus, the finger 130 has a rear section 135 that extends from the fixed end 134 to protrude partially out of the lower surface 114 of the securing plate 110 and a front section 133 that returns or extends back towards the plate 110, including an intermediate round/flat bottom corner 136 protruding from the lower plate surface 114.

As the securing plate 110 is made of a plastic material that is resiliently deformable, each finger 130 is bendable about its fixed end 134 upwards back into the securing plate 110, when its bottom corner 136 is subject to compression.

The fan blade 300 has a generally flat, slightly twisted elongate wooden body 310 having upper and lower surfaces 312 and 314 and including an inner end 316 at which three circular holes 320 are formed. The three holes 320 are arranged in a triangular manner, with one of them positioned immediately behind the extremity of the blade end 316 and the other two holes 320 outwardly of the first hole 320 and symmetrically about a principal axis of the blade body 310.

The three apertures 120 of the securing device 100 and the three holes 320 of the fan blade 300 are arranged in the same triangular manner such that they can be aligned with each other. More specifically, the larger ends 124 of the apertures 120 have the same diameter as the holes 320.

The connecting arm 200 is moulded from metal and has a first end 210 for connection to the rotor of a ceiling fan motor (not shown), a second end 220 for connection to the fan blade 300, and an arcuate link 230 integrally interconnecting the two ends 210 and 220. The first end 210 is arcuate and extends across the associated end of the link 230 in a T-shaped arrangement, which is formed with a pair of holes 212 at opposite ends to permit the use of bolts and nuts for connection to the said rotor. The second end 220 is in the form of an enlarged oblong flat tray 220 that extends generally horizontally at a lower level from the first end 210.

The tray 220 has a base wall 221 and three internally screw-threaded studs 222 upstanding from the base wall 221. The studs 222 are arranged in a triangular manner, with one of them positioned adjacent the associated end of the link 230 and the other two studs 222 near the free end of the tray 220 and symmetrically about a principal axis of the tray 220.

Each stud 222 supports a brass bolt 224 and a tubular plastic sleeve 226 in a co-axial manner. The bolt 224 has a flat head 224A and an externally screw-threaded shaft 224B that is mated with the stud 222 through screw-thread engagement. The sleeve 226 has a pair of upper and lower wider sections 226A and 226C of about the same diameter and an intermediate narrower section 226B. With the sleeve 226 disposed over and around the stud 222, the bolt 224 is inserted down into the sleeve 226 and then tightened with the stud 222 until the sleeve 226 is clamped, thereby together forming a male member 228.

The bolt head 224A has the same diameter as the upper sleeve section 226A, which are combined to form an engagement end 228A of the male member 228, with the intermediate sleeve section 226B being relatively narrower to form a neck 228B behind the engagement end 228A. The engagement end 228A has a diameter marginally smaller than that of the larger end 124 of each aperture 120 of the securing device 100 and/or each hole 320 of the fan blade 300, such that the end 228A can pass through the relevant aperture 120 and hole 320. The intermediate sleeve section 226B has a length slightly larger than the thickness of the securing plate 110, for engaging it as described below.

The three male members 228 are arranged in a triangular manner as dictated by the studs 222. This triangular arrangement is identical to that of the three apertures 120 of the securing device 100 and/or the three holes 320 of the fan blade 300, such that the corresponding parts 120, 320 and 228 can be aligned for engagement.

The securing device 100 is used to secure the connecting arm 200 to the ceiling fan blade 300. Initially, the arm 200 is connected to the fan blade 300 by having its three male members 228 inserted through the corresponding holes 320 from the lower surface 314 to the upper surface 312 of the blade 300. When the male members 228 stop, both the engagement ends 228A and the necks 228B protrude substantially completely beyond the upper blade surface 312.

In use, the securing device 100 is laid over the engagement ends 228A, with the larger ends 124 of its apertures 120 aligned with the respective engagement ends 228A protruding out of the upper blade surface 312. The securing plate 110 is then lowered onto the upper blade surface 312 such that the larger ends 124 of its apertures 120 pass over the respective engagement ends 228A. Subsequently, the securing plate 110 is manually pressed down to lie flat against the upper blade surface 312 counteracting resilience of the fingers 130. When this is being done, the fingers 130 are compressed to bend about their fixed ends 134 upwards into the securing plate 110, with their rear sections 135 pressing flat against the upper blade surface 312. In this condition, the engagement ends 228A extend through the apertures 120 out of the upper surface 112 of the securing plate 110, and the necks 228B stay within the apertures 120.

The smaller ends 122 of the apertures 120 have a diameter marginally larger that that or the cross-section of the necks 228B, such that the securing plate 110 is slidable, while being pressed down, in direction Y along the upper blade surface 312 relative to the engagement ends 228A. When this is being done, the necks 228B enter relatively into the corresponding smaller aperture ends 122, with the result that the rim portions of the aperture ends 122 engage with and behind the corresponding engagement ends 228A. The securing plate 110 will stop when the extremities of the aperture ends 122 reach the necks 228B, whereupon the engagement ends 228A fall relatively into and are thus engaged by the respective recesses 128 upon release of the securing plate 110 from manual compression.

The securing plate 110 is retained in position on the fan blade 300 through engagement by the engagement ends 228A of the male members 228, by reason of its resilient fingers 130 pressing tightly against the upper surface 312 of the blade 300.

The fingers 130 serve to frictionally engage or to grip the blade surface 312 so as to fix the securing plate 110, and in particular hold it against sliding back relative to the blade 300 in the opposite direction X. In this regard, as the fingers 130 point in direction X, they grip the fan blade 300 relatively more firmly in this direction X than in the other direction Y. The fingers 130 also ensure that the recesses 128 (extending over an angle of 270°) stay engaging with the engagement ends 228A, such that the securing plate 110 is located against sliding back relative to the blade 300 in direction X.

The fingers 130 and the apertures 120 are arranged at alternating positions relatively to each other in a triangular loop, with one finger 130 positioned between each pair of adjacent apertures 120 or vice versa. Thus, the engagement between each aperture 130 and the respective male member 228 is maintained under the resilient action of more than one nearby finger 130, i.e. two nearby fingers 130.

The invention has been given by way of example only, and various modifications of and/or alterations to the described embodiment may be made by persons skilled in the art without departing from the scope of the invention as specified in the appended claims.

What is claimed is:

1. A securing device for securing a connecting arm to a ceiling fan blade, the arm including a male member comprising an engagement portion and a neck portion behind the engagement portion, and the ceiling fan blade including a hole through which the male member is insertable from a first surface to an opposite second surface of the ceiling fan blade such that the engagement portion and neck portion protrude beyond the second surface, the securing device comprising:

a body having at least one aperture through which the engagement portion protruding beyond the second blade surface is extendable with the neck portion within the aperture, the aperture including a part having a rim and a size between sizes of the engagement portion and the neck portion such that, when the engagement portion extends through the aperture, the body is slidable in a first direction along the second blade surface until the rim portion engages behind the engagement portion, the rim having an enlarged rim portion for receiving and engaging the engagement portion in a second direction opposite to the first direction, and at least one resilient member resiliently deformable upon engaging the second blade surface when the rim portion engages behind the engagement portion, thereby maintaining, by resilience of the resilient member, engagement of the enlarged rim portion with the engagement portion in the second direction.

2. The securing device as claimed in claim 1, wherein said resilient member is resiliently deformable to engage the second blade surface by friction when the rim portion engages behind the engagement portion, thereby holding said body against sliding relative to the blade in the second direction.

3. The securing device as claimed in claim 1, wherein said body comprises a generally flat plate.

4. The securing device as claimed in claim 1, wherein said body is substantially completely a resiliently deformable material.

5. The securing device as claimed in claim 4, wherein the material comprises a plastic material.

6. The securing device as claimed in claim 1, wherein the aperture has an oblong shape, comprising a relatively larger end through which the engagement portion protruding beyond the second blade surface is extendable and a relatively smaller end acting as part of the aperture.

7. The securing device as claimed in claim 6, wherein the larger and smaller ends of the aperture lie in the first and second directions, respectively.

8. The securing device as claimed in claim 6, wherein said body comprises three apertures, the engagement portion of a respective male member of the arm protruding through a corresponding one of the apertures, beyond which the second blade surface extends.

9. The securing device as claimed in claim 8, wherein the three apertures are positioned at respective corners of a triangle on said body.

10. The securing device as claimed in claim 1, wherein said resilient member comprises a first part connected to said body and a second part that extends from said first part and protrudes from said body for engaging the second blade surface.

11. The securing device as claimed in claim 10, wherein said second part of said resilient member extends from said first part in the second direction.

12. The securing device as claimed in claim 10, wherein said resilient member comprises a first section that extends from said first part and protrudes from said body and includes said second part for engaging the second blade surface, and a second section that extends from said second part towards said body.

13. The securing device as claimed in claim 10, comprising three of said resilient members protruding from said body for engaging the second blade surface.

14. The securing device as claimed in claim 13, wherein said three resilient members are arranged at corners of a triangle on said body.

15. The securing device as claimed in claim 1, wherein said body includes apertures and including a plurality of said resilient members, the apertures and said resilient members being arranged at alternating positions relative to each other.

16. A securing device for securing a connecting arm to a ceiling fan blade, the arm including a male member comprising an engagement portion and a neck portion behind the engagement portion, the ceiling fan blade including a hole through which the male member is insertable from a first surface to an opposite second surface of the blade such that the engagement portion and the neck portion protrude beyond the second surface, wherein the securing device comprises a body having at least one aperture through which the engagement portion protruding beyond the second blade surface is extendable with the neck portion within the aperture, the aperture includes a part having a rim portion and a size between sizes of the engagement portion and the neck portion such that, when the engagement portion extends through the aperture, said body is slidable in a first direction along the second blade surface until said rim portion engages behind the engagement portion, and said body includes at least one resilient member resiliently deformable to engage the second blade surface by friction when the rim portion engages behind the engagement portion, thereby holding said body against sliding relative to said ceiling fan blade in a second direction, opposite the first direction.

17. The securing device as claimed in claim 16, wherein said rim portion is enlarged for receiving and engaging the engagement portion in the second direction, and said resilient member is resiliently deformable upon engaging the second blade surface when said rim portion engages behind the engagement portion, thereby maintaining, under resilience of the resilient member, engagement of said enlarged rim portion with the engagement portion in the second direction.

18. The securing device as claimed in claim 16, wherein said body comprises a generally flat plate.

19. The securing device as claimed in claim 16, wherein said body is substantially completely a resiliently deformable material.

20. The securing device as claimed in claim 19, wherein the material comprises a plastic material.

21. The securing device as claimed in claim 16, wherein the aperture has an oblong shape, comprising a relatively larger end through which the engagement portion protruding beyond the second blade surface is extendable and a relatively smaller end as part of the aperture.

22. The securing device as claimed in claim 21, wherein the larger and smaller ends of the aperture lie in the first and second directions, respectively.

23. The securing device as claimed in claim 21, wherein said body comprises three apertures, the engagement portion of a respective male member of the arm protruding through a corresponding one of the apertures, beyond which the second blade surface extends.

24. The securing device as claimed in claim 23, wherein the three apertures are positioned at respective corners of a triangle on said body.

25. The securing device as claimed in claim 16, wherein said resilient member comprises a first part connected to said body and a second part that extends from said first part and protrudes from said body for engaging the second blade surface.

26. The securing device as claimed in claim 25, wherein said second part of said resilient member extends from said first part in the second direction.

27. The securing device as claimed in claim 25, wherein said resilient member comprises a first section that extends from said first part and protrudes from said body and includes said second part for engaging the second blade surface, and a second section that extends from said second part towards said body.

28. The securing device as claimed in claim 25, comprising three of said resilient members protruding from said body for engaging the second blade surface.

29. The securing device as claimed in claim 28, wherein said three resilient members are arranged at corners of a triangle on said body.

30. The securing device as claimed in claim 16, wherein said body includes apertures and including a plurality of said resilient members, the apertures and said resilient members being arranged at alternating positions relative to each other.

* * * * *